US008397817B2

(12) United States Patent
Edwards

(10) Patent No.: US 8,397,817 B2
(45) Date of Patent: Mar. 19, 2013

(54) METHODS FOR DOWNHOLE SAMPLING OF TIGHT FORMATIONS

(75) Inventor: John E. Edwards, Medinat Al Alam (OM)

(73) Assignee: Schlumberger Technology Corporation, Sugar Land, TX (US)

( * ) Notice: Subject to any disclaimer, the term of this patent is extended or adjusted under 35 U.S.C. 154(b) by 310 days.

(21) Appl. No.: 12/858,554

(22) Filed: Aug. 18, 2010

(65) Prior Publication Data

US 2012/0043080 A1 Feb. 23, 2012

(51) Int. Cl.
*E21B 43/26* (2006.01)
*E21B 49/10* (2006.01)

(52) U.S. Cl. ..... 166/308.1; 166/100

(58) Field of Classification Search ..... 166/250.1, 166/308.1, 100, 177.5
See application file for complete search history.

(56) References Cited

U.S. PATENT DOCUMENTS

| | | | | |
|---|---|---|---|---|
| 2,516,421 | A * | 7/1950 | Robertson | 175/78 |
| 3,530,933 | A * | 9/1970 | Whitten | 166/100 |
| 4,339,948 | A | 7/1982 | Hallmark | |
| 4,860,581 | A | 8/1989 | Zimmerman et al. | |
| 4,936,139 | A | 6/1990 | Zimmerman et al. | |
| 5,131,472 | A | 7/1992 | Dees et al. | |
| 5,195,588 | A | 3/1993 | Dave | |
| 5,233,866 | A * | 8/1993 | Desbrandes | 73/152.05 |
| 5,353,637 | A | 10/1994 | Plumb et al. | |
| 5,517,854 | A | 5/1996 | Plumb et al. | |
| 5,687,806 | A * | 11/1997 | Sallwasser et al. | 175/62 |
| 5,692,565 | A | 12/1997 | MacDougall et al. | |
| 5,746,279 | A * | 5/1998 | Havlinek et al. | 175/52 |
| 5,779,085 | A | 7/1998 | Havlinek et al. | |
| 6,119,782 | A | 9/2000 | Flores et al. | |
| 6,167,968 | B1 | 1/2001 | Allarie et al. | |
| 6,274,865 | B1 * | 8/2001 | Schroer et al. | 250/269.1 |
| 6,772,839 | B1 | 8/2004 | Bond | |
| 7,380,599 | B2 * | 6/2008 | Fields et al. | 166/264 |
| 7,484,563 | B2 * | 2/2009 | Zazovsky et al. | 166/264 |
| 7,614,294 | B2 | 11/2009 | Hegeman et al. | |
| 7,677,316 | B2 * | 3/2010 | Butler et al. | 166/308.1 |
| 7,703,517 | B2 * | 4/2010 | Tarvin et al. | 166/264 |
| 7,845,405 | B2 * | 12/2010 | Villareal et al. | 166/264 |
| 7,999,542 | B2 * | 8/2011 | Ramamoorthy et al. | 324/303 |
| 2003/0051876 | A1 | 3/2003 | Tolman et al. | |

(Continued)

FOREIGN PATENT DOCUMENTS

WO 2009065793 A1 5/2009

OTHER PUBLICATIONS

International Search Report and Written Opinion of PCT Application No. PCT/US2011/048262 dated Mar. 15, 2012.

(Continued)

*Primary Examiner* — Daniel P Stephenson
(74) *Attorney, Agent, or Firm* — James Kurka; Robin Nava; Daryl Wright

(57) ABSTRACT

There is provided a method of sampling a subterranean formation. The method includes the steps of creating a side bore into the wall of a well traversing the formation, sealing the wall around the side bore to provide a pressure seal between the side bore and the well, pressurizing the side bore beyond a pressure inducing formation fracture while maintaining the seal, pumping a fracturing fluid adapted to prevent a complete closure of the fracture through the side bore into the fracture, and reversing the pumping to sample formation fluid through the fracture and the side bore.

12 Claims, 4 Drawing Sheets

U.S. PATENT DOCUMENTS

| | | | | |
|---|---|---|---|---|
| 2004/0069487 | A1 | 4/2004 | Cook et al. | |
| 2008/0066536 | A1 | 3/2008 | Goodwin et al. | |
| 2008/0135299 | A1 | 6/2008 | Fields et al. | |
| 2009/0114385 | A1 | 5/2009 | Lumbye | |
| 2009/0250207 | A1 | 10/2009 | May | |
| 2009/0255669 | A1 | 10/2009 | Ayan et al. | |
| 2009/0318313 | A1 | 12/2009 | Ali et al. | |
| 2010/0084134 | A1 | 4/2010 | Tulissi et al. | |
| 2010/0155061 | A1 | 6/2010 | Zazovsky et al. | |
| 2012/0043077 | A1 * | 2/2012 | Edwards | 166/250.1 |
| 2012/0043078 | A1 * | 2/2012 | Ziauddin et al. | 166/250.1 |

OTHER PUBLICATIONS

International Search Report and Written Opinion of PCT Application No. PCT/US2011/048256 dated Mar. 15, 2012.

International Search Report and Written Opinion of PCT Application No. PCT/US2011/048253 dated Mar. 15, 2012.

Al-Harthy et al., "Options for High-Temperature Well Stimulation," Oilfield Review, 2008/2009, vol. 20(4): pp. 52-62.

Arora et al., "SPE 129069: Single-well In-situ Measurement of Residual Oil Saturation after an EOR Chemical Flood," SPE International, 2010: pp. 1-18.

Cherukupalli et al., "SPE 136767: Analysis and Flow Modeling of Single Well MicroPilot to Evaluate the Performance of Chemical EOR Agents," SPE International, 2010: pp. 1-16.

Edwards et al., "SPE 141091: Single-well In-situ Measure of Oil Saturation Remaining in Carbonate after an EOR Chemical Flood," SPE International, 2011: pp. 1-12.

Kristensen et al., "IPTC 14507: Feasibility of an EOR MicroPilot for Low-Salinity Water Flooding," International Petroleum Technology Conference, Feb. 2012: pp. 1-14.

Lea et al., "Simulation of Sandstone Acidizing of a Damaged Perforation," SPE Production Engineering, May 1992: pp. 212-218.

Liu et al., "OSEA 8810: Effects of Perforation Flow Geometry on Evaluation of Perforation Flow Efficiency," 7th Offshore South East Asia Conference, Feb. 1988: pp. 322-330.

Martin et al., "SPE 135669: Best Practices for Candidate Selection, Design and Evaluation of Hydraulic Fracture Treatments," SPE International, 2010: pp. 1-13.

Prouvost et al., "Applications of Real-Time Matarix-Acidizing Evaluation Method," SPE Production Engineering, Nov. 1989: pp. 401-407.

Rae et al., "SPE 82260: Matarix Acid Stimulation—A Review of the State-of-the-Art," SPE International, 2003: pp. 1-11.

Ramamoorthy et al., "Introducing the Micropilot : Moving Rock Flooding Experiments Downhole," SPWLA 53rd Annual Logging Symposium, Jun. 2012: pp. 1-16.

Schechter et al., "Example 7.2 Production of Oil Through a Single Undamaged Perforation," Oil Well Stimulation, New Jersey: Prentice Hall, 1992: p. 223.

Soliman et al., "SPE 130043: Fracturing Design Aimed at Enhancing Fracture Complexity," SPE International, 2010: pp. 1-20.

* cited by examiner

METHODS FOR DOWNHOLE SAMPLING OF TIGHT FORMATIONS

FIELD OF THE INVENTION

The present invention is generally related to methods of sampling subterranean formations of low permeability particularly tight gas bearing formations.

BACKGROUND

The oil and gas industry typically conducts comprehensive evaluation of underground hydrocarbon reservoirs prior to their development. Formation evaluation procedures generally involve collection of formation fluid samples for analysis of their hydrocarbon content, estimation of the formation permeability and directional uniformity, determination of the formation fluid pressure, and many other parameters. Measurements of such parameters of the geological formation are typically performed using many devices including downhole formation testing tools.

Recent formation testing tools generally comprise an elongated tubular body divided into several modules serving predetermined functions. A typical tool may have a hydraulic power module that converts electrical into hydraulic power; a telemetry module that provides electrical and data communication between the modules and an uphole control unit; one or more probe modules collecting samples of the formation fluids; a flow control module regulating the flow of formation and other fluids in and out of the tool; and a sample collection module that may contain various size chambers for storage of the collected fluid samples. The various modules of such a tool can be arranged differently depending on the specific testing application, and may further include special testing modules, such as NMR measurement equipment. In certain applications the tool may be attached to a drill bit for logging-while-drilling (LWD) or measurement-while drilling (MWD) purposes.

Among the various techniques for performing formation evaluation (i.e., interrogating and analyzing the surrounding formation regions for the presence of oil and gas) in open, uncased boreholes have been described, for example, in U.S. Pat. Nos. 4,860,581 and 4,936,139, assigned to the assignee of the present invention. An example of this class of tools is Schlumberger's MDT™, a modular dynamic fluid testing tool, which further includes modules capable of analyzing the sampled fluids. In a variant of the method the sampler is located between a pair of straddle packers to isolate a section of a well which can then be fractured and sampled.

To enable the same sampling in cased boreholes, which are lined with a steel tube, sampling tools have been combined with perforating tools. Such cased hole formation sampling tools are described, for example, in the U.S. Pat. No. 7,380,599 to T. Fields et al. and further citing the U.S. Pat. Nos. 5,195,588; 5,692,565; 5,746,279; 5,779,085; 5,687,806; and 6,119,782, all of which are assigned to the assignee of the present invention. The '588 patent by Dave describes a downhole formation testing tool which can reseal a hole or perforation in a cased borehole wall. The '565 patent by MacDougall et al. describes a downhole tool with a single bit on a flexible shaft for drilling, sampling through, and subsequently sealing multiple holes of a cased borehole. The '279 patent by Havlinek et al. describes an apparatus and method for overcoming bit-life limitations by carrying multiple bits, each of which are employed to drill only one hole. The '806 patent by Salwasser et al. describes a technique for increasing the weight-on-bit delivered by the bit on the flexible shaft by using a hydraulic piston.

Another perforating technique is described in U.S. Pat. No. 6,167,968 assigned to Penetrators Canada. The '968 patent discloses a rather complex perforating system involving the use of a milling bit for drilling steel casing and a rock bit on a flexible shaft for drilling formation and cement.

U.S. Pat. No. 4,339,948 to Hallmark discloses an apparatus and methods for testing, then treating, then testing the same sealed off region of earth formation within a well bore. It employs a sealing pad arrangement carried by the well tool to seal the test region to permit flow of formation fluid from the region. A fluid sample taking arrangement in the tool is adapted to receive a fluid sample through the sealing pad from the test region and a pressure detector is connected to sense and indicate the build up of pressure from the fluid sample. A treating mechanism in the tool injects a treating fluid such as a mud-cleaning acid into said sealed test region of earth formation. A second fluid sample is taken through the sealing pad while the buildup of pressure from the second fluid sample is indicated.

Methods and tools for performing downhole fluid compatibility tests include obtaining an downhole fluid sample, mixing it with a test fluid, and detecting a reaction between the fluids are described in the co-owned U.S. Pat. No. 7,614,294 to P. Hegeman et al. The tools include a plurality of fluid chambers, a reversible pump and one or more sensors capable of detecting a reaction between the fluids. The patent refers to a downhole drilling tool for cased hole applications.

In the light of above known art it is seen as an object of the present invention to improve and extend methods of sampling downhole formations, particular "tight" formations of low permeability. Prominent examples of such tight formations are shale gas formations.

The sampling of tight shale gas formation, which can be very thick, poses a problem to existing sampling tools and methods as the reservoir fluids are not easily extracted from the formation. Hence it is not easy to determine whether a newly drilled section of tight formation is potentially productive or not, even though important technical and economic decisions depend on correct answers to this question.

Among the methods used are formation sampling with a straddle packer configuration, underbalanced drilling, which allows for influx from the reservoir into the drilled well, and exploration fracturing. The latter is an extensive fracturing process on par in cost and complexity with normal fracturing operations.

However none of the known methods are entirely satisfactory as formations can be too tight for the typical one square meter of wellbore wall between the pair of packers to produce a significant sample. Underbalanced drilling on the other hand is typically vastly more expansive and dangerous compared to conventional drilling and the reservoir depth of any gas influx is difficult to determine with the necessary precision. There is further the suspicion that tight formations may not release trapped gas until fractured.

Therefore it is seen as the only reliable method to fully fracture the formation for a comprehensive test. However fracturing thick formations along their entire length becomes a very expansive operation as shale gas formation may stretch for more than 1000 m and considering that exploration fracturing may only cover 20 m to 50 m intervals at a time and at a cost of several million dollars per interval. The problem of deriving new and improved testing methods is therefore one of great importance for tight formations.

SUMMARY OF INVENTION

Hence according to a first aspect of the invention there is provided a method of sampling a subterranean formation, including the steps of creating a side bore into the wall of a well traversing the formation, sealing the wall around the side bore to provide a pressure seal between the side bore and the well, pressurizing the side bore beyond a pressure inducing formation fracture while maintaining the seal, pumping a fracturing fluid adapted to prevent a complete closure of the fracture through the side bore into the fracture, and reversing the pumping to sample formation fluid through the fracture and the side bore.

The side bore is preferably drilled in direction of the maximum horizontal stress, if this direction is prior knowledge.

In a preferred embodiment the fracturing fluid adapted to prevent a complete closure of the fracture can carry either solid proppant or a corrosive component which is capable of etching away at the exposed surface of a fracture.

The method is furthermore best applied to formations of low permeability, which are believed to confine the spread of a fracture to the desired directions. A formation is considered to be of low permeability if the permeability at the test location is less than 100 mD (millidarcy) or less than 20 mD or even less than 10 mD. The methods is believed to be superior to existing sampling method for tight reservoirs, particularly shale gas reservoirs.

The method enables fracturing opening with minimal use of hydraulic fluids. With the new method the amount of fracturing fluid used and carried within the tool body can be less than 50 liters, preferable less than 20 liters and even less 5 liters including proppant or acidizing components of it. Besides being sufficiently small to be carried downhole with the body of tool, the small amount of fluid allows for the use of more specialized and hence more expensive fracturing fluids. Such specialized fluids include for example fluids with a sufficiently high density to keep proppant buoyant.

These and other aspects of the invention are described in greater detail below making reference to the following drawings.

DETAILED DESCRIPTION

Figure 1:
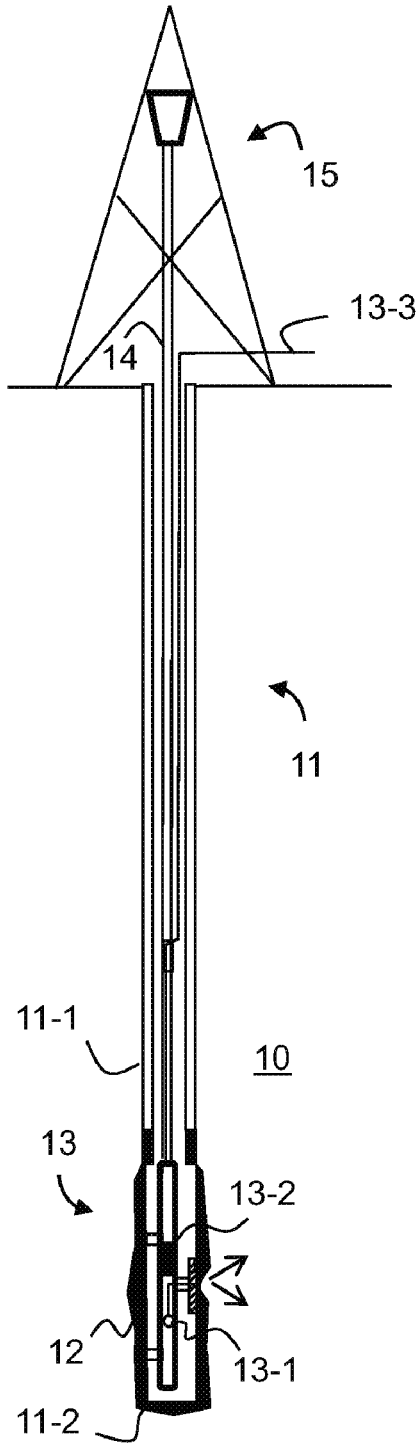
FIG. 1 shows a typically deployment of a formation drilling and sampling tool while performing steps in accordance with an example of the present invention.

In FIG. 1, a well 11 is shown drilled through a formation 10. The well 11 includes an upper cased section 11-1 and a lower openhole section 11-2. The lower openhole section is shown with a layer 12 of formation damaged and invaded through a prior drilling process which left residuals of the drilling fluids in the layer surrounding the well.

In this example of the invention, a wireline tool 13 is lowered into the well 11 mounted onto a string of drillpipe 14. The drill string 14 is suspended from the surface by means of a drilling rig 15. In the example as illustrated, the wireline tool includes a formation testing device 13-1 combined with a formation drilling device 13-2. Such tools are known per se and commonly used to collect reservoir fluid samples from cased sections of boreholes. The CHDT™ open hole drilling and testing tool as offered commercially by Schlumberger can be regarded as an example of such a tool. The connection to the surface is made using a wireline 13-3 partly guided along the drill string 14 (within the cased section 11-1 of the well 11) and partly within the drill string (in the open section 11-2).

The operation of this combined toolstring in a downhole operation in accordance with an example of the invention is illustrated schematically in the following FIGS. 2-4.

In the example, it is assumed that the stresses around the well 11 have been logged using standard methods such acoustic or sonic logging. At a target depth, the tool 13 is oriented such that it is aligned in directions of the maximum horizontal stress. It is in this direction that fractures typically open first when the whole well is pressurized in a normal fracturing operation. The mounted tool 13 can be rotated by rotating the drill string 14 and thus assume any desired orientation in the well 11.

Figure 2:
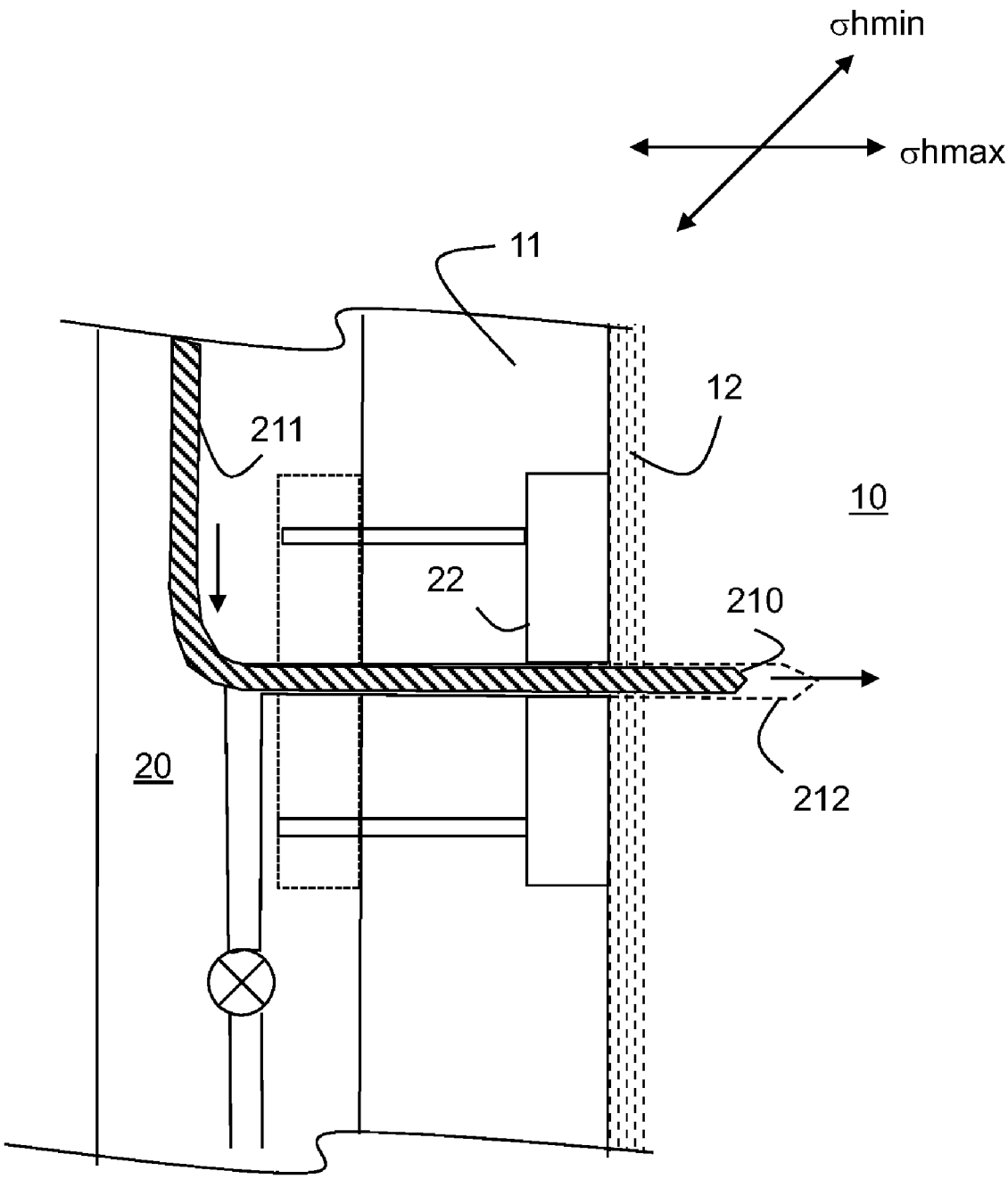
FIG. 2 illustrates the step of drilling a side bore to an existing well in accordance with an example of the present invention.

Making use of the conventional operation mode of the CHDT tool 13, the body 20 of the tool as shown in more detail in FIG. 2 includes a small formation drill bit 210 mounted on an internal flexible drill string 211. While the tool is kept stationary using the sealing pad 22 and counterbalancing arms (not shown), the flexible drill 210 can be used to drill a small side bore 212 into the formation 10 surrounding the well 11.

In the example, a 9 mm diameter hole 212 is drilled to an initial depth of 7.62 cm (3-in) before reaching the final depth of 15.24 cm (6-in). The drilling operation is monitored with real-time measurements of penetration, torque and weight on bit. The bit is automatically frequently tripped in and out of the hole to remove cuttings. The bit 210 trips can be manually repeated without drilling if a torque increase indicates a buildup of cuttings.

After the drilling of the side bore 212, reservoir fluids are produced to clean it of any cuttings that could adversely affect the subsequent injection. After the clean-out, the pressure in the side bore 212 is increased by pumping a (fracturing) fluid either from a reservoir with the tool or from within the well through the tool.

Figure 3A:
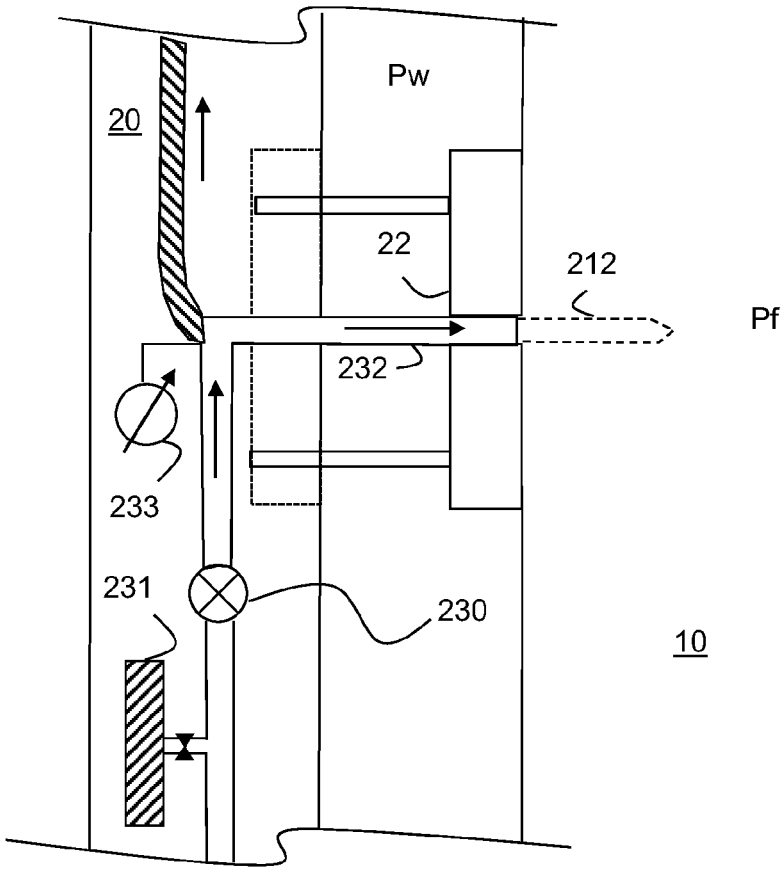
FIGS. 3A and 3B illustrate the step of fracturing the formation in the vicinity of a side bore in accordance with an example of the present invention.

As shown in FIG. 3A, the pump module 230, which is a positive displacement pump when using the CHDT tool, is activated in reverse after completing the clean-out of the side bore 212 and a fluid is injected from an internal reservoir 231 through an inner flow line 232 of the tool into the side bore 212. In the example the internal reservoir carries a highly viscous fracturing fluid mixed with a proppant. The fracturing fluid can include polymers or visco-elastic surfactants as known in the art of fracturing from the surface. The proppant can be sand or other particulate material including granular or fibrous material. To pump such viscous fluid it can be necessary to use actively controlled valves in the pump in place of simple spring loaded valves which have a propensity of clogging in the presence of a flow containing solid particles.

It is important for the present invention that the pad 22 maintains during the injection stages a seal against the well pressure Pw. The sealing pad in the present example seals an area of 7.3 cm by 4.5 cm. A pressure sensor 233 is used to monitor the pressure profile versus time during the operation.

Any loss of seal can be noticed by comparing the pressure in the side bore with the well pressure Pw.

Figure 3B:
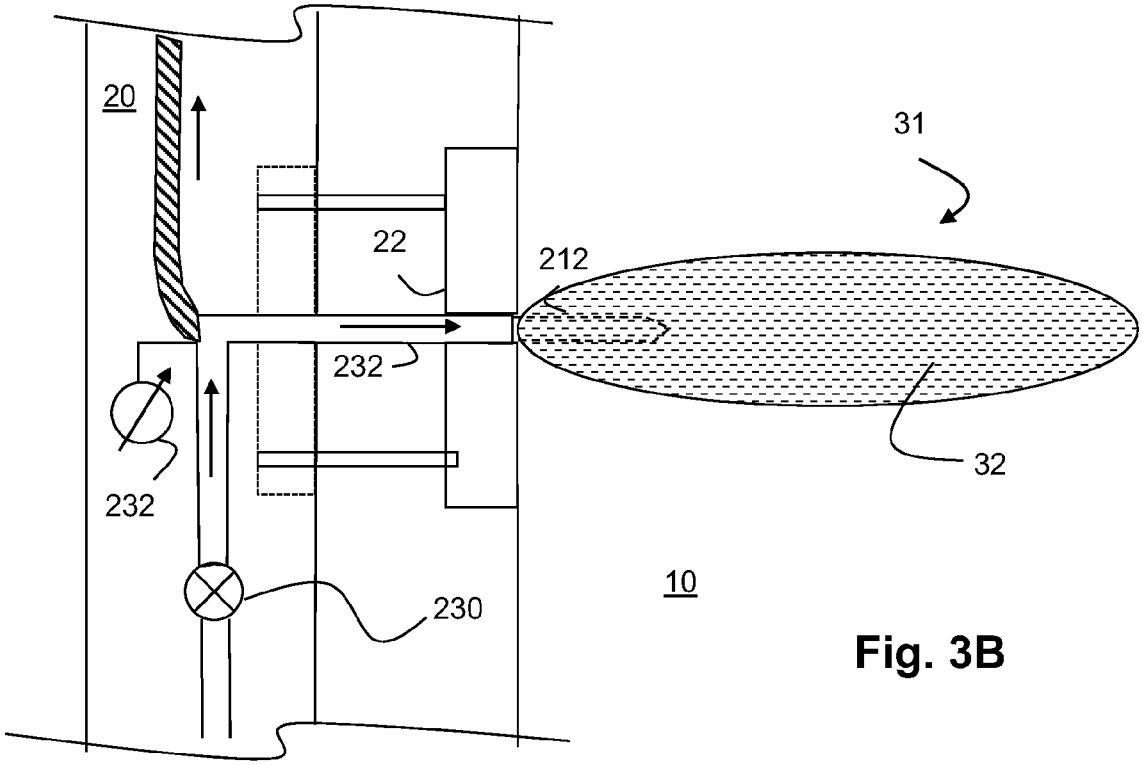

The injection pressure can be increased steps of for example 500 kPa increments, with pressure declines between each increment. Eventually the formation breakdown pressure is reached and a fracture 31 as shown in FIG. 3B develops at the location of the side bore 212.

In the carbonate formation of 1-10 mD of the example the fracture initiation pressure was established as 19080 kPa. The fracturing fluid 32 and the proppant it carries fill the fracture as shown in FIG. 3B.

Figure 4A:
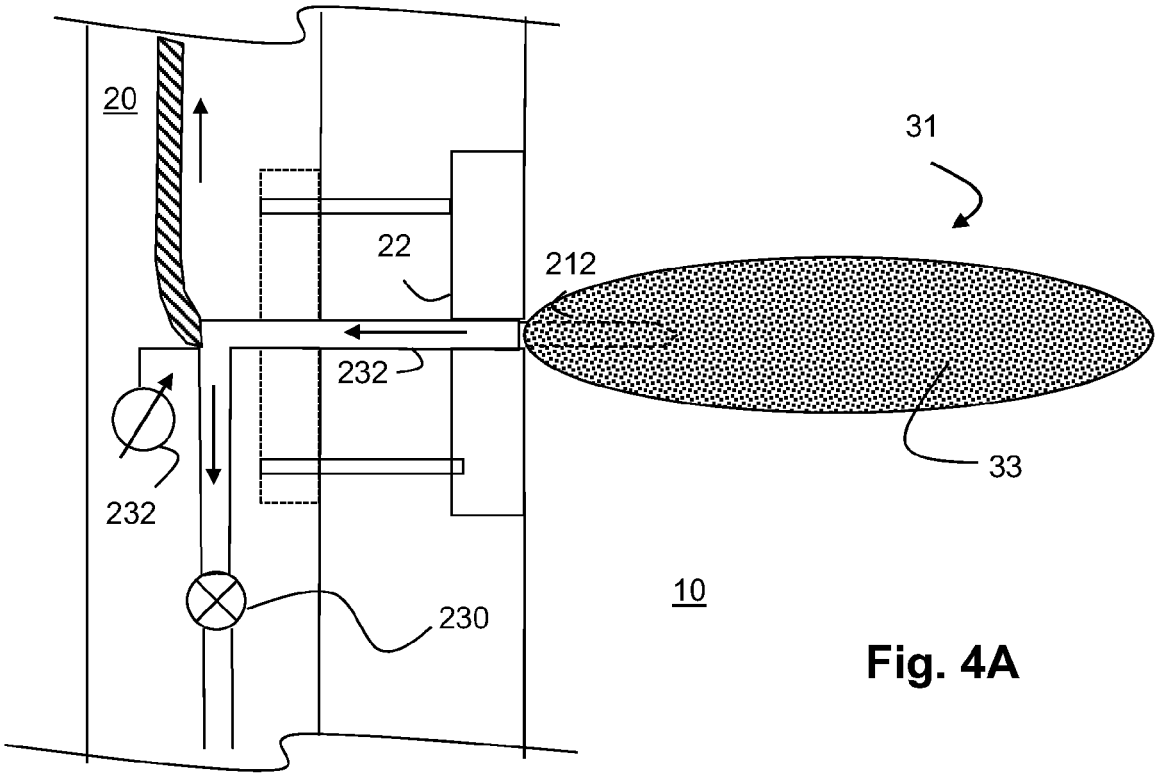
FIGS. 4A and 4B illustrate the step of sampling the formation in the vicinity of a side bore through a fracture in accordance with an example of the present invention.
Figure 4B:
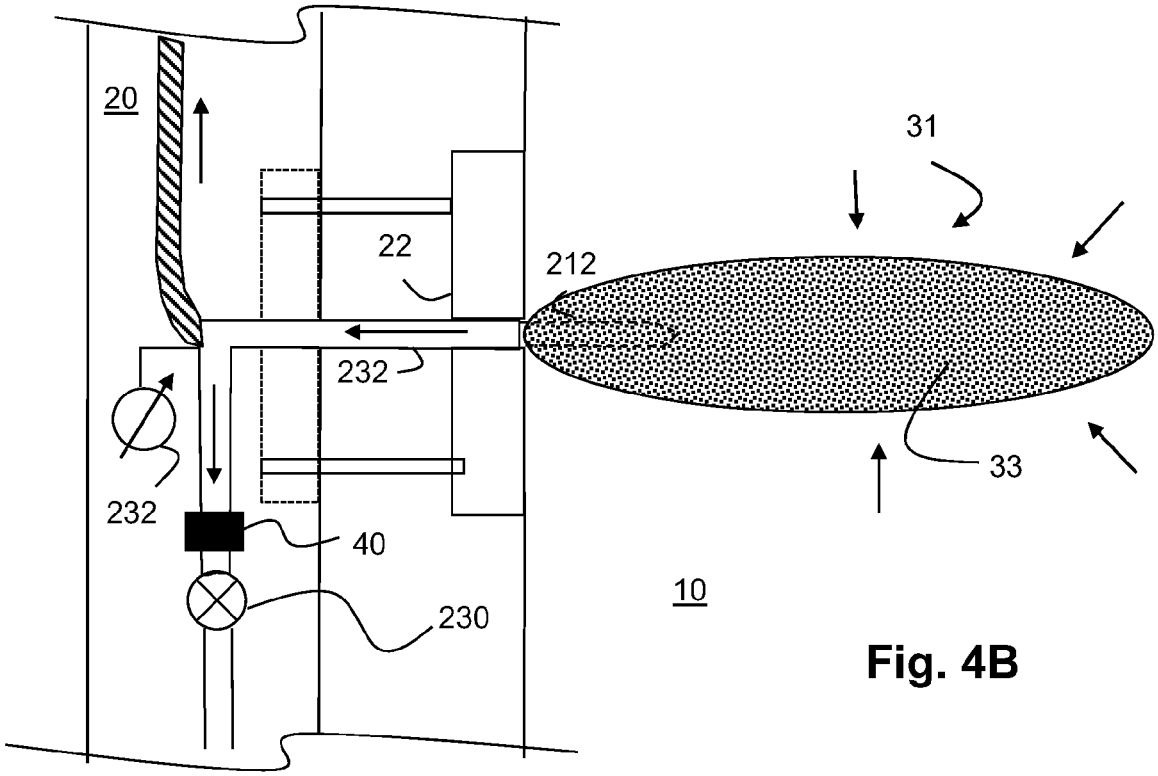

In the steps as illustrated in FIG. 4A and FIG. 4B, the pumping direction is reversed and initially the fracturing fluid is cleaned from the fracture leaving the proppant 33 behind. The role of the proppant is to prevent a closure of the fracture and hence maintain a channel of higher permeability through which formation fluid is drawn into the tool. Once the fracturing fluid ceases to block the fracture, formation fluids such as shale gas can enter the flow path into the tool as shown in FIG. 4B.

An optical analyzing module 40 as available in the MDT tool can be used to switch the tool from a clean-out mode to a sampling mode, in which the fluid pumped into a sampling container (not shown).

By confining the pressure to single location and smaller volume a much smaller volume of fluid is required for the fracturing testing. Conventional fracturing tests on open hole formations with pairs of straddle packers generate fractures by pressurizing the much larger volume of the well between the two packers and create hence much larger fractures. With new method volume of less than 100 liters or 50 liters, or even less 20 liters appear sufficient to perform the tests. In turn these small volumes enable the use of smaller high differential pumps which typically have a slow pump rate without extending the downhole test time.

Furthermore given the small volumes needed for the fracturing dedicated and expensive fracturing fluids can be used in the present invention which would otherwise be ruled out for fracturing from the surface for economic reasons.

For example very heavy liquids with densities up to 2.95 g/ml are available from commercial sources. Among these liquids are organic heavy liquids (TBE, bromoform), tungstate heavy liquids such as lithium heteropolytungstates (LST). The latter liquid can reach a density up to 2.95 g/mL at 25 C, and a density of 3.6 g/mL at elevated temperatures.

These heavy liquids will keep the proppant neutrally buoyant in the sample chamber and remove the need to use viscous fracturing fluids. Viscous fluids can damage the permeability of the induced fracture, and may have to be remedied by other "breaker" fluids. Suspending the proppant with buoyancy can be applied in a simpler fashion but is practical when only a small volume of the fluid is required, and when the weight of fracturing fluid does not influence the fracturing pressure. These conditions are not given in conventional fracturing operations when the fracturing fluid fills the well bore from reservoir to surface, and contributes to the pressure with its hydrostatic weight.

Another alternative method for preventing a complete closure of a fracture created is to include in the fluid a corrosive or acid component that damages the surfaces of the induced fracture thus preventing it from resealing. The acid achieves the same purpose as the proppant. This alternative is seen as more practical when small fluid volumes are involved, for example chosen from the range of 5-20 liters, than for conventional fracture operations where the entire well bore from reservoir to surface has to be filled with the fluid.

Moreover, while the preferred embodiments are described in connection with various illustrative processes, one skilled in the art will recognize that the system may be embodied using a variety of specific procedures and equipment. Accordingly, the invention should not be viewed as limited except by the scope of the appended claims.

What is claimed is:

1. A method of sampling a subterranean formation, comprising the steps of suspending a tool with side bore drilling, fluid storage and pumping capability from the surface to a desired location in a well;

creating a side bore into the wall of a well traversing said formation;

sealing said wall around the side bore to provide a pressure seal between said side bore and said well;

pressurizing the side bore beyond a pressure inducing formation fracture while maintaining said seal;

pumping a fracturing fluid adapted to prevent a complete closure of said fracture from a reservoir inside said tool through said side bore into said fracture; and reversing the pumping to sample formation fluid through said fracture and said side bore.

2. A method in accordance with claim 1, wherein the side bore is drilled in direction of the maximum horizontal stress.

3. A method in accordance with claim 1, wherein the formation is uncased at the location of the side bore.

4. A method in accordance with claim 1, wherein the formation is a low permeability formation.

5. A method in accordance with claim 1, wherein the formation is a low permeability formation with a permeability below 100 mD.

6. A method in accordance with claim 1, wherein the formation is a low permeability formation with a permeability below 20 mD.

7. A method in accordance with claim 1, wherein the formation is a gas bearing shale formation of low permeability formation or tight gas formation.

8. A method in accordance with claim 1, wherein the volume of fracturing fluid is less than 100 liters.

9. A method in accordance with claim 1, wherein the volume of fracturing fluid is less than 20 liters.

10. A method in accordance with claim 1, wherein fracturing fluid comprises a proppant.

11. A method in accordance with claim 10, wherein fracturing fluid has a density sufficient to keep the proppant buoyant for the time required to position the tool fracture and inject the fracturing fluid.

12. A method in accordance with claim 1, wherein fracturing fluid comprises a corrosive component for etching exposed surface of the fracture.

* * * * *